US009919858B2

(12) United States Patent
Fujihara

(10) Patent No.: US 9,919,858 B2
(45) Date of Patent: Mar. 20, 2018

(54) BUFFERING MEMBER

(71) Applicant: KYOCERA Document Solutions Inc., Osaka (JP)

(72) Inventor: Masami Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/450,459

(22) Filed: Mar. 6, 2017

(65) Prior Publication Data

US 2017/0283153 A1 Oct. 5, 2017

(30) Foreign Application Priority Data

Mar. 29, 2016 (JP) ..... 2016-066466

(51) Int. Cl.
*B65D 81/05* (2006.01)

(52) U.S. Cl.
CPC ..... *B65D 81/054* (2013.01); *B65D 2581/053* (2013.01)

(58) Field of Classification Search
CPC ..... B65D 81/054; B65D 2581/053; B65D 81/053; B65D 81/05
USPC ..... 206/586, 523, 453
See application file for complete search history.

(56) References Cited

U.S. PATENT DOCUMENTS 2,692,720 A * 10/1954 Suess ..... B65D 81/056 206/586
3,064,801 A * 11/1962 Linnell ..... B65D 81/056 206/453
3,334,798 A * 8/1967 Pezely, Jr. ..... A63F 9/1204 206/523
3,695,421 A * 10/1972 Wood ..... B65D 81/057 206/523
3,780,929 A * 12/1973 Terrasi ..... B65D 81/054 206/326
3,854,650 A * 12/1974 Hanaue ..... B65D 81/107 16/DIG. 13
4,972,954 A * 11/1990 Dickie ..... B65D 5/509 206/523
8,752,707 B2 * 6/2014 McDonald ..... B65D 81/057 206/453
2011/0056867 A1 * 3/2011 Ohsawa ..... B65D 81/053 206/586

FOREIGN PATENT DOCUMENTS

JP 2007-118965 A 5/2007

* cited by examiner

*Primary Examiner* — Steven A. Reynolds
(74) *Attorney, Agent, or Firm* — Studebaker & Brackett PC

(57) ABSTRACT

A buffering member is interposed between an outer corner of a packaged article and an inner corner of a packaging box. The buffering member includes a base sheet and a plurality pairs of blocks. The base sheet is foldable along a folding line. The plurality of pairs of blocks are arranged along the folding line at predetermined intervals. Each block of the pair of blocks is bonded on one face and the other face of the base sheet on both side of the folding line. The pair of blocks is combined via a combined face so as to meet the outer corner when the base sheet is folded along the folding line. At least one of the combined faces is provided on the one face of the base sheet and another combined face is provided on the other face of the base sheet.

7 Claims, 5 Drawing Sheets

Prior Art

BUFFERING MEMBER

INCORPORATION BY REFERENCE

This application is based on and claims the benefit of priority from Japanese Patent application No. 2016-066466 filed on Mar. 29, 2016, which is incorporated by reference in its entirety.

BACKGROUND

The present disclosure relates to a buffering member interposed between an outer corner of a packaged article and an inner corner of a packaging box.

When a packaged article, for example, an image forming apparatus such as a printer and a copying machine, is packaged into a packaging box, buffering members are interposed between outer corners of the packaged article and inner corners of the packaging box. Such a buffering member has an L-shaped plan view so as to meet the outer corner of the packaged article. If such an L-shaped buffering member is formed by a single product, a volume of the buffering member may increase. Thereby, such an L-shaped buffering member is generally formed by a pair of blocks which are combined into an L-shape.

In a buffering member 101 shown in FIGS. 5A and 5B, a pair of blocks 112 is sometimes bonded on a base sheet 111 which is foldable along a folding line 115 formed along an inner corner of a packaging box 3. In this case, the pair of blocks 112 includes a rectangular parallelepiped long block 117 and a rectangular parallelepiped short block 118. The long block 117 is bonded on the base sheet 111 on one side of the folding line 115 along the folding line 115 with a posture in which its length direction is perpendicular to the folding line 115. The short block 118 is bonded on the base sheet 111 on the other side of the folding line 115 at a position separate from the folding line 115 with a posture in which its length direction is perpendicular to the folding line 115. When the base sheet 111 is folded along the folding line 115 at right angles, the long block 117 and the short block 118 are combined via a combined face S into an L-shaped plan view forming a right angle.

If an packaged article 2 has a large size, a plurality of pairs of blocks 112 are provided at predetermined intervals along the folding line 115. When a plurality of pairs of blocks 112 are provided, the long blocks 117 are bonded on one face 111*a* of the base sheet 111 on one side of the folding line 115 and the short blocks 118 are bonded on the other face 111*b* of the base sheet 111 on the other side of the folding line 115 in many cases. That is, the combined faces S of the pairs of blocks 112 are provided on a side of the other face 111*b* of the base sheet 111.

If the packaging box 3 in which the packaged article 2 is packaged via the above buffering member 101 is fallen with its outer corner downward, impact is applied on bonded faces between each of the blocks 117 and 118 and the base sheet 111 (the bonded faces are shown by hatching in FIG. 5B). Because the bonded face between the short block 118 and the base sheet 111 is separated from the folding line 115 and the both blocks 117 and 118 are not bonded at the combined face S, when the impact is applied on the bonded faces, the long block 117 and the short block 118 are relatively slid along the combined face S, as shown in FIG. 5B. As a result, a crease P may be generated on the base sheet 111 at the bonded face between the short block 118 and the base sheet 111. If all of the combined faces S are provided on the side of the other face 111*b* of the base sheet 111, the creases P are connected into a linier crease P. Then, a relative position of the long block 117 and the short block 118 may be displaced, and thus a position where the outer corner of the packaged article 2 meets is changed and an assumed buffering performance cannot be obtained.

In order to prevent such a positional displacement of the pair of blocks 112, one end face 117*a* of the long block 117 may be bonded on the other face 111*b* of the base sheet 111 such that the both blocks 117 and 118 are bonded on the base sheet 111 at all of contact faces between the both blocks 117 and 118 and the base sheet 111. However, in such a case, the base sheet 111 is kept in a folded posture along the folding line 115 (a posture shown in FIG. 5A) and a volume of the buffering member may increase, resulting in increase in transporting cost.

SUMMARY

In accordance with an aspect of the present disclosure, a buffering member interposed between an outer corner of a packaged article and an inner corner of a packaging box includes a base sheet and a plurality pairs of blocks. The base sheet is foldable along a folding line formed along the inner corner. The plurality of pairs of blocks are arranged along the folding line at predetermined intervals. Each block of the pair of blocks is bonded on one face and the other face of the base sheet on both side of the folding line. The pair of blocks is combined via a combined face so as to meet the outer corner when the base sheet is folded along the folding line. At least one of the combined faces is provided on the one face of the base sheet and another combined face is provided on the other face of the base sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, a buffering member according to one embodiment of the present disclosure will be described.

Figure 1:
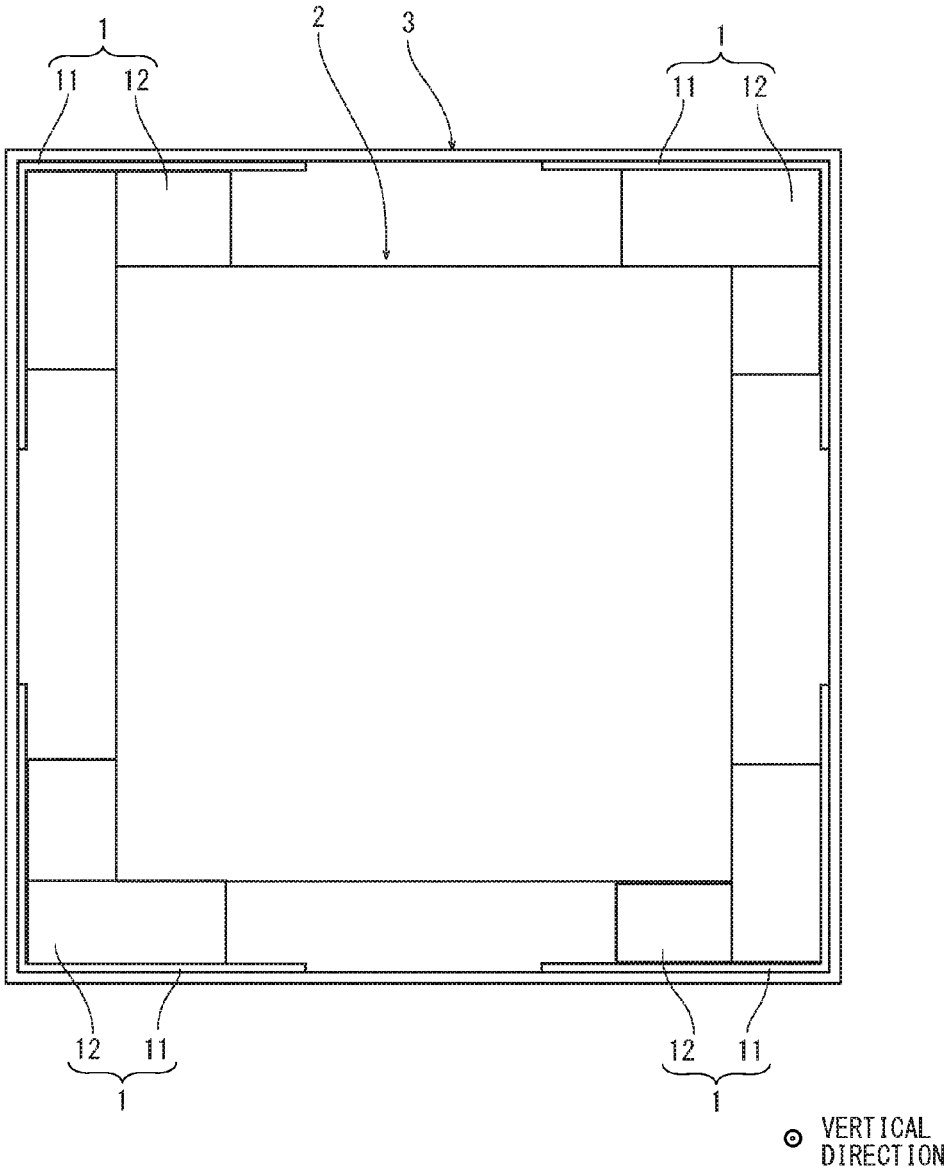
FIG. 1 is a plan view showing a packaging box in which a packaged article is packaged via a buffering member according to an embodiment of the present disclosure.

With reference to FIG. 1, the buffering member 1 of the present disclosure will be described. The buffering members 1 are interposed between four outer corners of an image forming apparatus 2 as a packaged article and four outer corners of a packaging box 3. In the embodiment, the buffering member 1 is interposed between an outer corner between adjacent side faces of the image forming apparatus 2 and an inner corner between adjacent side plates of the packaging box 3.

Figure 2:
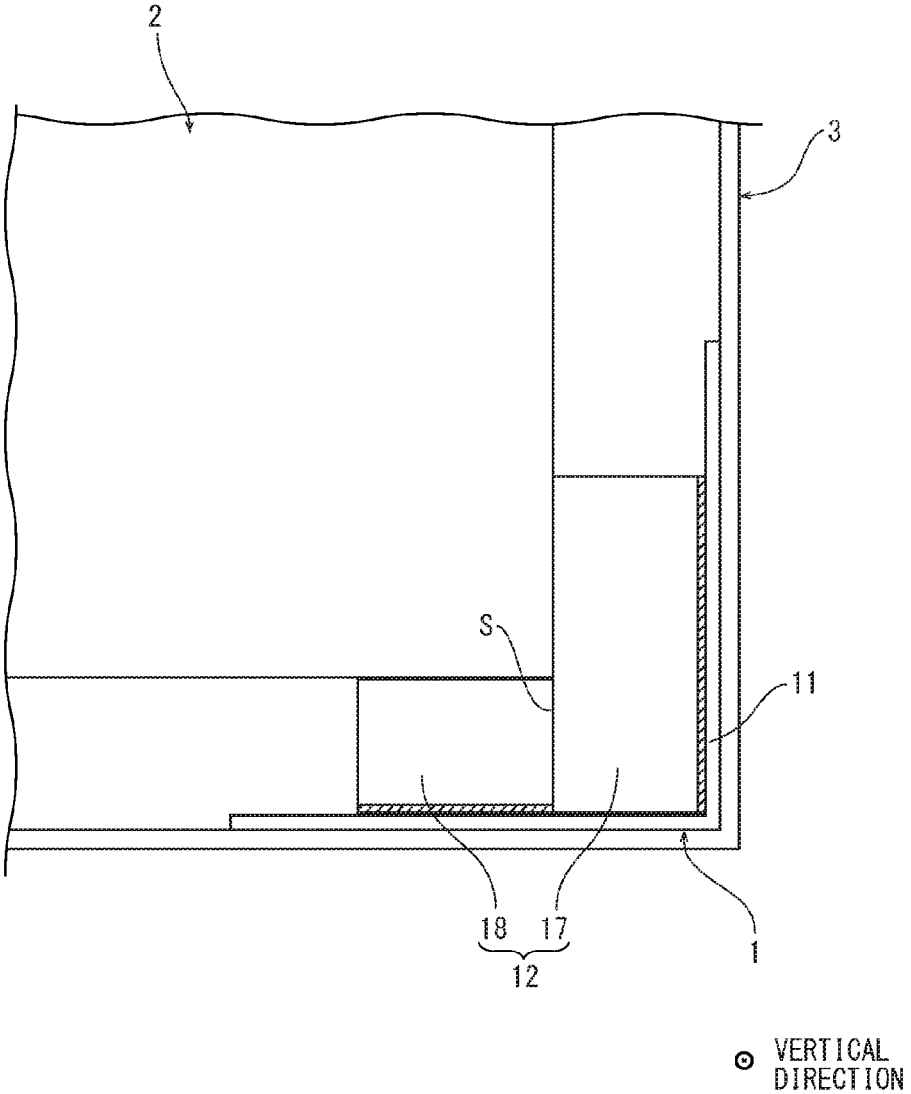
FIG. 2 is a plan view showing the buffering member according to the embodiment of the present disclosure.
Figure 3:
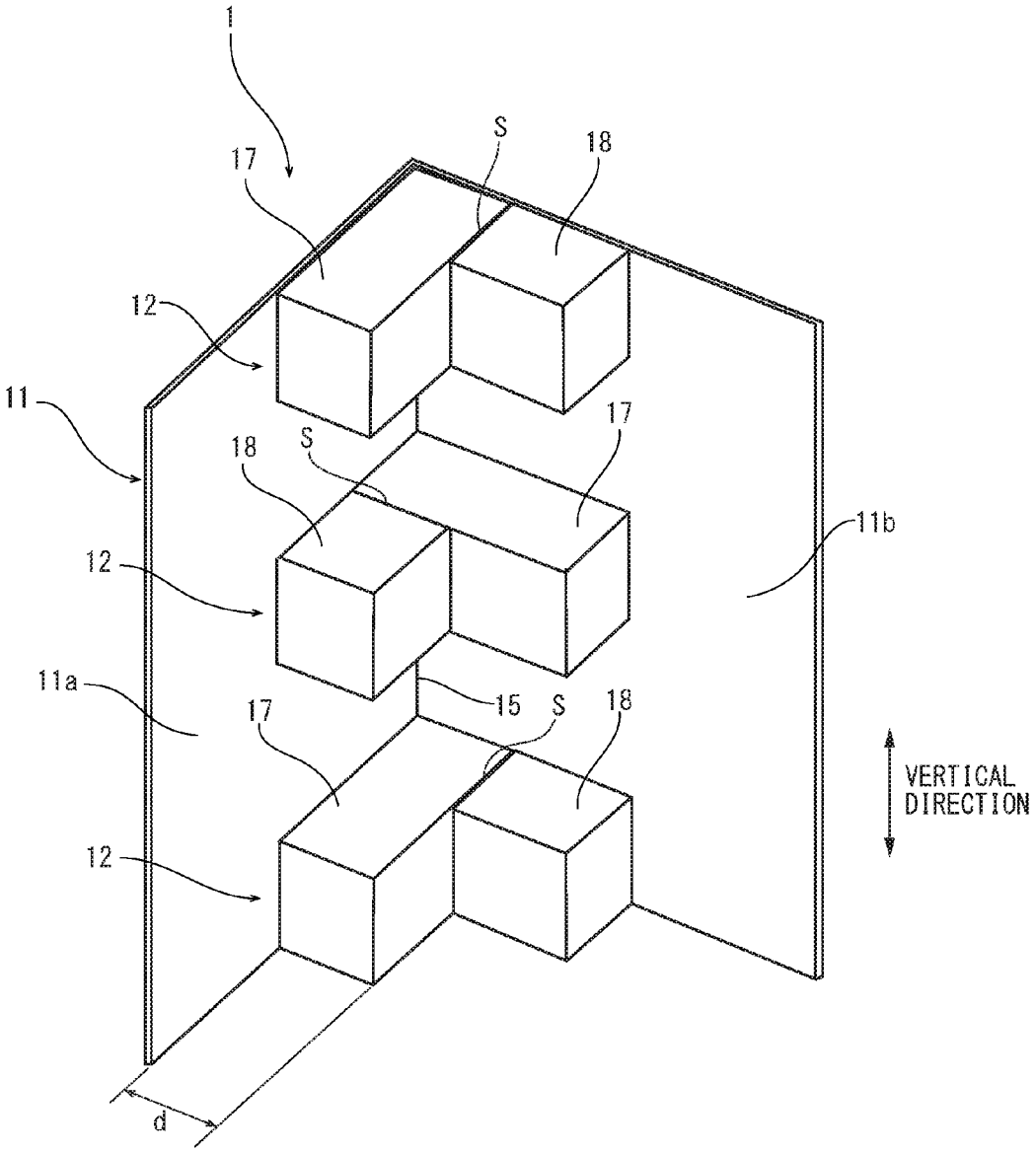
FIG. 3 is a perspective view showing the buffering member according to the embodiment of the present disclosure.
Figure 4:
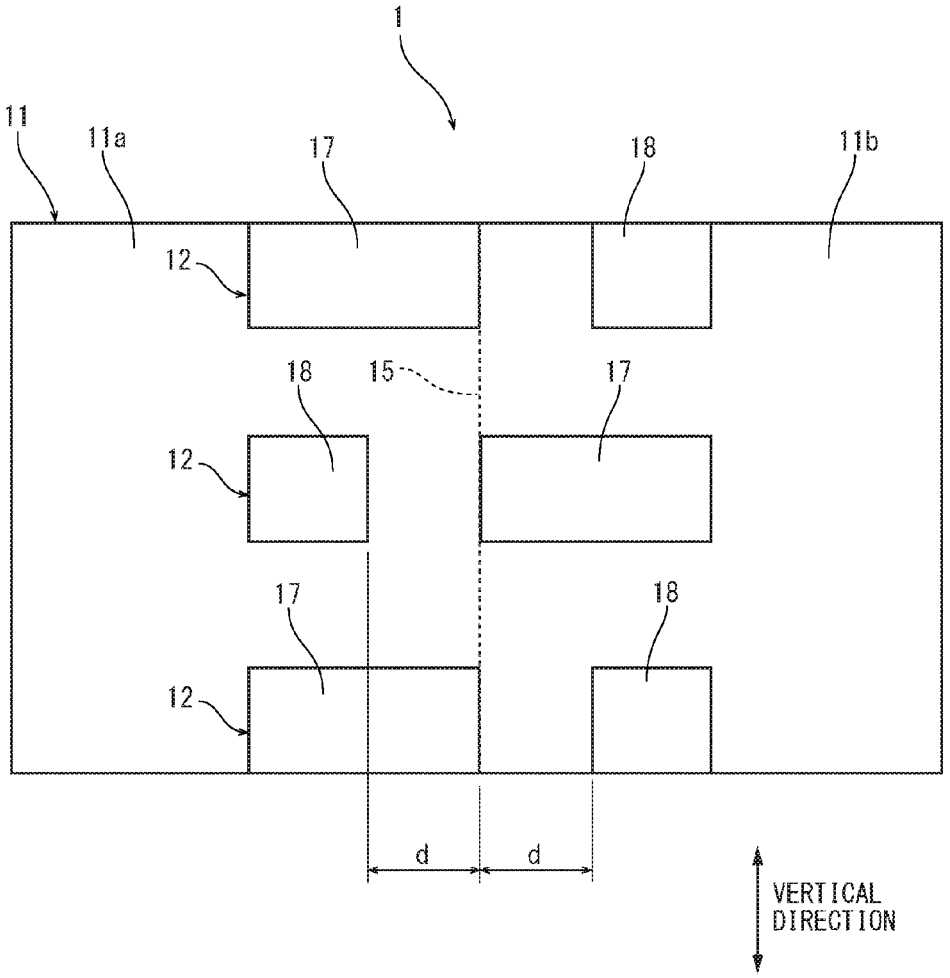
FIG. 4 is a development view showing the buffering member according to the embodiment of the present disclosure.

With reference to FIGS. 2 to 4, a structure of the buffering member 1 will be described. FIG. 2 is a plan view showing the buffering member interposed between the packaged article and the packaging box, FIG. 3 is a perspective view showing the buffering member and FIG. 4 is a development view showing the buffering member. In the flowing description, a vertical direction shows the vertical direction shown in each figure, and a horizontal direction shows a direction perpendicular to the vertical direction.

As shown in FIG. 2, the buffering member 1 includes a base sheet 11 and three pairs of blocks 12. The base sheet 11 is configured to meet the inner corner of the packaging box 3. The three pairs of blocks 12 are bonded on the base sheet 11 so as to meet the outer corner of the image forming apparatus 2.

The base sheet 11 has a rectangular shape. The base sheet 11 is valley foldable along a folding line 15 extending in the vertical direction. The base sheet 11 is made of cardboard.

Each of the pairs of blocks 12 includes a rectangular parallelepiped long block 17 long in the horizontal direction and a rectangular parallelepiped short block 18 having a horizontal length shorter than that of the long block 17. Each of blocks 17 and 18 is made by laminating a plurality of rectangular cardboards and then bonding them together.

As shown in FIGS. 3 and 4, the three pairs of blocks 12 are arranged in the vertical direction along the folding line 15 at predetermined intervals. In the upper and lower pairs of blocks 12, the long blocks 17 are bonded on one side face 11*a* of the base sheet 11 on one side of the folding line 15 and the short blocks 18 are bonded on the other side face 11*b* of the base sheet 11 on the other side of the folding line 15. In detail, the long block 17 and the short block 18 are symmetrical with respect to the folding line 15 in each pair. The long block 17 extends from the folding line 15 in the horizontal direction which is perpendicular to the folding line 15. The short block 18 extends in the horizontal direction from a position separate from the folding line 15 by a predetermined horizontal distance d. The distance d is equal to a protruding length of the long block 17 from the base sheet 11.

On the other hand, in the center pair of blocks 12, the long block 17 is bonded on the other side face 11*b* of the base sheet 11 and the short block 18 is bonded on the one side face 11*a* of the base sheet 11. In detail, the long block 17 and the short block 18 are symmetrical with respect to the folding line 15. The long block 17 extends from the folding line 15 in the horizontal direction. The short block 18 extends in the horizontal direction from a position separate from the folding line 15 by a predetermined horizontal distance d. The distance d is equal to a protruding length of the long block 17 from the base sheet 11. Bonded faces between each of the blocks 17 and 18 and the base sheet 11 are shown by hatching in FIG. 2.

When the base sheet 11 is valley folded along the folding line 15 at right angle, as shown in FIGS. 2 and 3, the long block 17 and the short block 18 are combined into a L-shaped plan view forming a right angle via a combined face S. As shown in FIG. 3, the combined faces S of the upper and lower pairs of blocks 12 are provided on the other side face 11*b* of the base sheet 11 while the combined face S of the center pair of blocks 12 is provided on the one side face 11*a* of the base sheet 11. In this way, the combined faces S of the pairs of blocks 12 adjacently arranged along the folding line 15 are provided on the different side faces of the base sheet 11. The combined faces S of the pairs of blocks 12 alternately arranged along the folding line 15 (the upper and lower pairs of blocks 12) are provided on the same side face of the base sheet 11.

The buffering member 1 having the above described configuration is interposed between the outer corner of the image forming apparatus 1 and the inner corner of the packaging box 3 after the base sheet 11 is valley folded along the folding line 15 at right angles. The base sheet 11 meets the inner corner between the side plates of the packaging box 3 and the three pairs of blocks 12 meets the outer corner between the side faces of the image forming apparatus 2.

When the packaging box 3 is fallen with the outer corner downward, in the three pairs of blocks 12, the outer corner of the apparatus main body 2 is abutted against corners at which the long blocks 17 and the short blocks 18 are combined at right angles so that impact applied on the apparatus main body 2 can be absorbed.

Figure 5A:
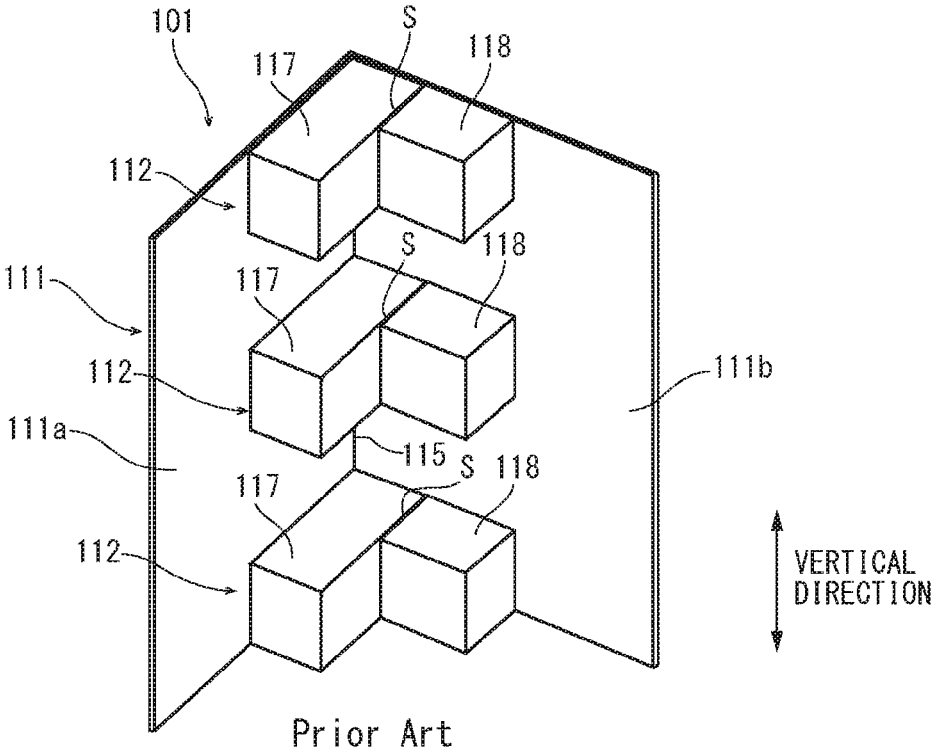
FIG. 5A is a perspective view showing a conventional buffering member.
Figure 5B:
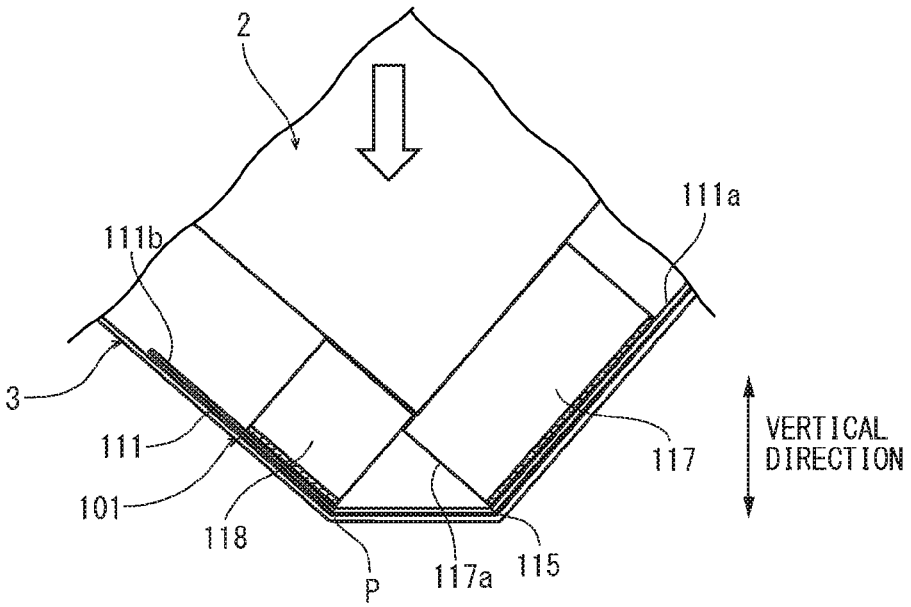
Prior Art FIG. 5B
FIG. 5B is a plan view showing the conventional buffering member deformed when the packaging box is fallen with its outer corner downward.

As described above, according to the buffering member 1 of the present disclosure, the combined faces S of the upper and lower pairs of blocks 12 and the combined face S of the center pair of blocks 12 are provided on the different side faces of the base sheet 11. Thereby, a bonded position of the short block 18 on the base sheet 11, where a crease is easy to be generated (refer to P, in FIG. 5B) when the packaging box 3 is fallen with its outer corner downward, are distributed into the one side face 11*a* and the other side face 11*b* of the base sheet 11. Accordingly, the linier crease is hardly generated on the base sheet 11. Therefore, the displacement of the pair of blocks 12 is prevented and the pair of blocks 12 combined at right angles can meet the outer corner of the image forming apparatus 2 so that an assumed buffering performance can be obtained.

However, it is not necessary to provide the combined faces S of the adjacently arranged pairs of blocks 12 on the different side faces of the base sheet 11. In addition, it is not necessary to provide the combined faces of the alternately arranged pairs of blocks 12 on the same side face of the base sheet 11. For instance, in a case of the image forming apparatus 2 having a tall size, a base sheet 11 having a high height and a plurality pairs of blocks 12 are required. In this case, the combined faces of the adjacently arranged pairs of blocks 12 are provided on the same side face of the base sheet 11, and the combined faces of the alternately arranged every two pairs of blocks 12 are provided on the different side faces of the base sheet 11. However, like the embodiment, it is preferable to provide the combined faces of the adjacently arranged pairs of blocks 12 on the different side faces and to provide the combined faces of the alternately arranged pairs of blocks on the same side face because the crease is hardly generated.

In addition, the long block 17 and the short block 18 are each made by a laminated cardboards block which is formed by laminating a plurality of cardboards and then bonding them together so as to have high strength. Accordingly, use of the laminated cardboards block can protect the image forming apparatus 2 surely. Furthermore, the blocks 17 and 18 can be formed inexpensively. However, the blocks 17 and 18 may be formed by another material, such as foamed resin.

In the embodiment, the buffering member 1 is interposed between the outer corner of the adjacently arranged side faces of the image forming apparatus 2 and the inner corner of the adjacently arranged side plates of the packaging box 3. However, the buffering member 1 may be interposed between an outer corner of an upper face and a side face adjacent to the upper face of the image forming apparatus 2 and an upper corner of the packaging box 3, or between an outer corner of a lower face and a side face adjacent to the lower face of the image forming apparatus 2 and an lower corner of the packaging box 3.

While the above embodiments has been described with reference to one embodiment of the buffering member according to the present disclosure. A technical range of the disclosure is not to be restricted by the above embodiments. The description of the above embodiment of the present disclosure has been described with reference to the particular illustrative embodiments, it is not to be restricted by the embodiments. The components in the embodiment of the disclosure may be suitably replaced with other components, or variously combined with the other components. The claims are not restricted by the description of the embodiment of the disclosure as mentioned above.

The invention claimed is:

1. A buffering member interposed between an outer corner of a packaged article and an inner corner of a packaging box, the buffering member comprising:

a base sheet foldable along a folding line formed along the inner corner, wherein the base sheet has one face on one side of the folding line and the other face on the other side of the folding line; and a plurality of pairs of blocks arranged along the folding line at predetermined intervals, each individual block of each pair of blocks being bonded on the one face and the other face, each pair of blocks being combined via a combined face so as to meet the outer corner of the packaged article when the base sheet is folded along the folding line, wherein at least one pair of blocks includes:

one rectangular parallelepiped block bonded on the one face of the base sheet at the fold line; and another rectangular parallelepiped block bonded on the other face of the base sheet at a position separate from the folding line, the two blocks are combined at right angles via the combined face, and at least one of the combined faces of the pairs of blocks is provided on the one face of the base sheet and another combined face is provided on the other face of the base sheet.

2. The buffering member according to claim 1, wherein the combined faces of the pairs of blocks adjacently arranged along the folding line is provided on the different faces of the base sheet.

3. The buffering member according to claim 1, wherein the combined faces of the pairs of blocks alternately arranged along the folding line are provided on the same face of the base sheet.

4. The buffering member according to claim 1, wherein the block bonded on the other face is separated from the folding line by a protruding length of the block bonded on the one face from the base sheet.

5. The buffering member according to claim 1, wherein the folding line is formed along the vertical direction.

6. The buffering member according to claim 1, wherein each block of the pairs of blocks is made of a laminated block which is formed by laminating a plurality cardboards and bonding them together.

7. The buffering member according to claim 1, wherein the packaged article is an image forming apparatus, and the buffering member is interposed between an outer corner between adjacent side faces of the image forming apparatus and the inner corner of the packaging box.

* * * * *